US009711900B1

(12) United States Patent
Brown

(10) Patent No.: US 9,711,900 B1
(45) Date of Patent: Jul. 18, 2017

(54) ELECTRICAL OUTLET SYSTEM

(71) Applicant: Terry Brown, Dallas, NC (US)

(72) Inventor: Terry Brown, Dallas, NC (US)

( * ) Notice: Subject to any disclaimer, the term of this patent is extended or adjusted under 35 U.S.C. 154(b) by 0 days.

(21) Appl. No.: 15/185,346

(22) Filed: Jun. 17, 2016

(51) Int. Cl.
*H01R 13/639* (2006.01)
*H01R 13/11* (2006.01)
*H01R 25/00* (2006.01)

(52) U.S. Cl.
CPC ..... *H01R 13/6395* (2013.01); *H01R 13/113* (2013.01); *H01R 25/006* (2013.01)

(58) Field of Classification Search
CPC .... H01R 12/774; H01R 13/20; H01R 13/113; H01R 13/443; H01R 13/447; H01R 13/629; H01R 13/6395; H01R 24/525; H01R 25/006
USPC ..... 439/373, 345, 346, 147, 148, 149
See application file for complete search history.

(56) References Cited

U.S. PATENT DOCUMENTS 2,448,339 A * 8/1948 Williams ..... H01R 13/443 200/51.02
D151,571 S 10/1948 Tillinghast
4,400,051 A 8/1983 Stenz
5,108,301 A * 4/1992 Torok ..... H01R 13/20 439/263
5,375,728 A 12/1994 West
5,997,319 A * 12/1999 Wu ..... H01R 13/4532 439/139
6,099,338 A * 8/2000 Huang ..... H01R 13/627 439/350
6,171,129 B1 * 1/2001 Phillips ..... H01R 13/193 439/263
6,358,076 B1 3/2002 Haag
6,537,089 B1 * 3/2003 Montague ..... H01R 13/4534 439/137
6,764,322 B1 * 7/2004 Yu ..... H01R 13/4532 439/106
7,320,613 B1 1/2008 Ratzlaff
7,347,703 B2 * 3/2008 Gallardo ..... H01R 13/6397 439/133
7,559,788 B2 * 7/2009 Legg ..... H01R 13/6395 439/371
7,651,348 B2 * 1/2010 Huang ..... H01R 13/4534 439/137
7,798,838 B2 * 9/2010 Grieff ..... H01R 13/639 439/346
7,828,572 B1 11/2010 Liu
7,857,654 B2 * 12/2010 West ..... H01R 13/6395 439/373
7,931,484 B2 * 4/2011 Chen ..... H01R 13/20 439/188
7,950,934 B2 * 5/2011 Sallam ..... H01R 13/4534 220/241

(Continued)

*Primary Examiner* — Tulsidas C Patel
*Assistant Examiner* — Travis Chambers

(57) ABSTRACT

An electrical outlet system for includes a female electrical outlet that is electrically coupled to a power source. The female electrical outlet has a pair of contacts. An adapter is removably coupled to the female electrical outlet and the adapter is positioned in each of the contacts. A plug is provided that has a pair of terminals. Each of the terminals is inserted through the adapter such that each of the terminals is electrically coupled to an associated one of the contacts. The adapter inhibits the terminals from falling out of the contacts.

5 Claims, 3 Drawing Sheets

(56) References Cited

U.S. PATENT DOCUMENTS

| | | | | |
|---|---|---|---|---|
| 8,366,463 | B2 * | 2/2013 | Zhang | H01R 13/4534 439/135 |
| 9,083,110 | B2 * | 7/2015 | McClelland | H01R 13/6205 |
| 2010/0120276 | A1 * | 5/2010 | White | H01R 13/447 439/148 |
| 2013/0112456 | A1 | 5/2013 | Nedrich | |
| 2015/0104968 | A1 * | 4/2015 | Hutchison | H01R 13/629 439/357 |

* cited by examiner

ELECTRICAL OUTLET SYSTEM

BACKGROUND OF THE DISCLOSURE

Field of the Disclosure

The disclosure relates to outlet devices and more particularly pertains to a new outlet device for inhibiting a plug from falling out of an electrical socket.

SUMMARY OF THE DISCLOSURE

An embodiment of the disclosure meets the needs presented above by generally comprising a female electrical outlet that is electrically coupled to a power source. The female electrical outlet has a pair of contacts. An adapter is removably coupled to the female electrical outlet and the adapter is positioned in each of the contacts. A plug is provided that has a pair of terminals. Each of the terminals is inserted through the adapter such that each of the terminals is electrically coupled to an associated one of the contacts. The adapter inhibits the terminals from falling out of the contacts.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
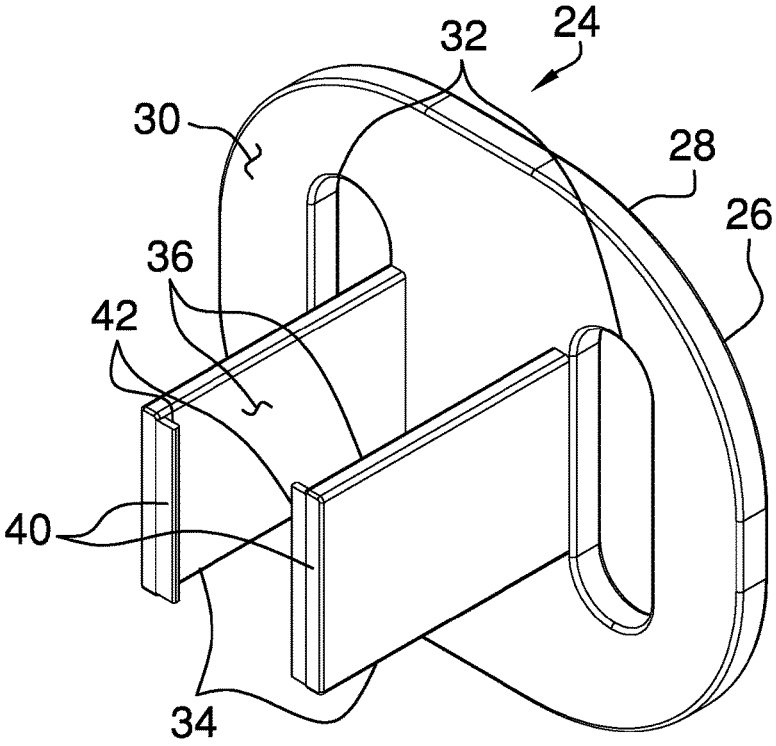
FIG. 1 is a back perspective view of an electrical outlet system according to an embodiment of the disclosure.
Figure 2:
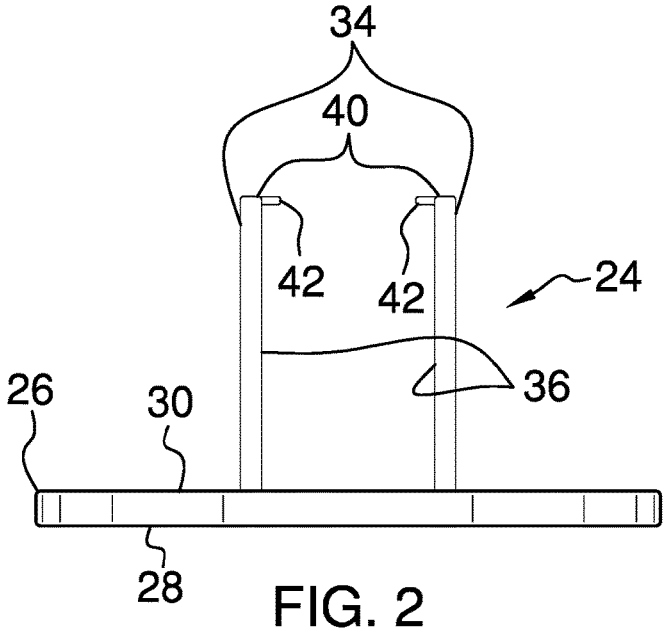
FIG. 2 is a top view of an embodiment of the disclosure.
Figure 3:
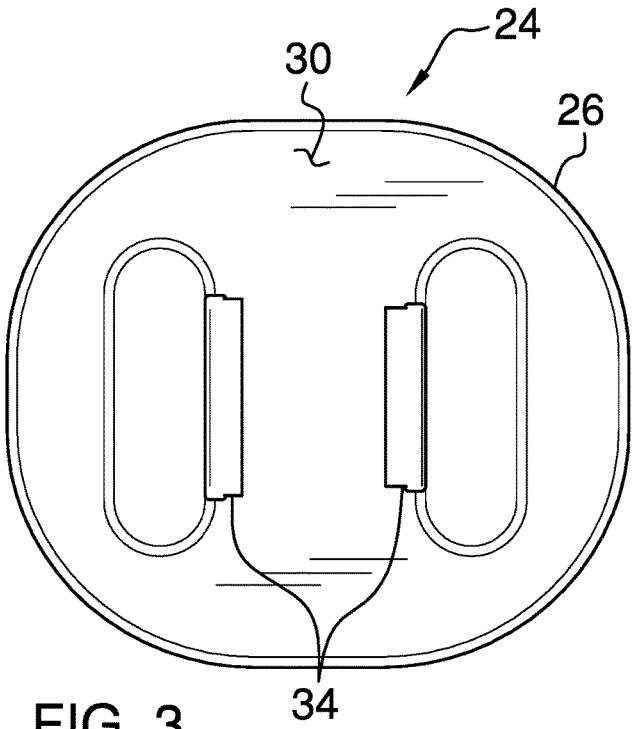
FIG. 3 is a back view of an embodiment of the disclosure.
Figure 4:
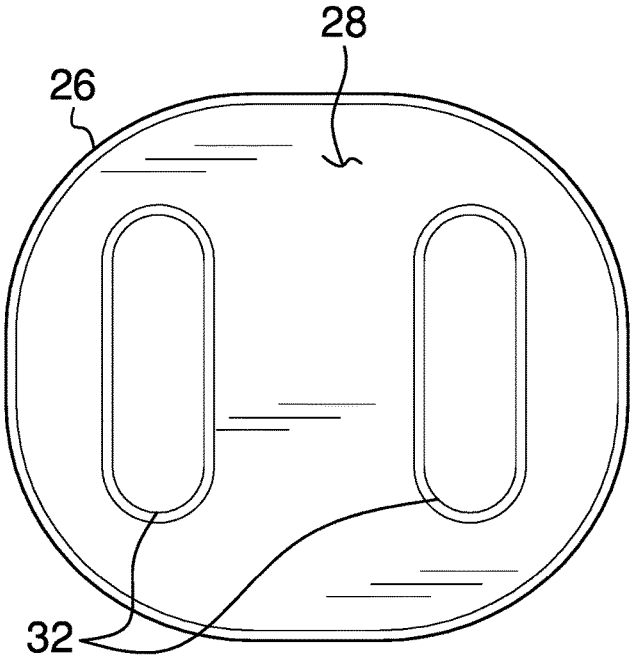
FIG. 4 is a front view of an embodiment of the disclosure.
Figure 5:
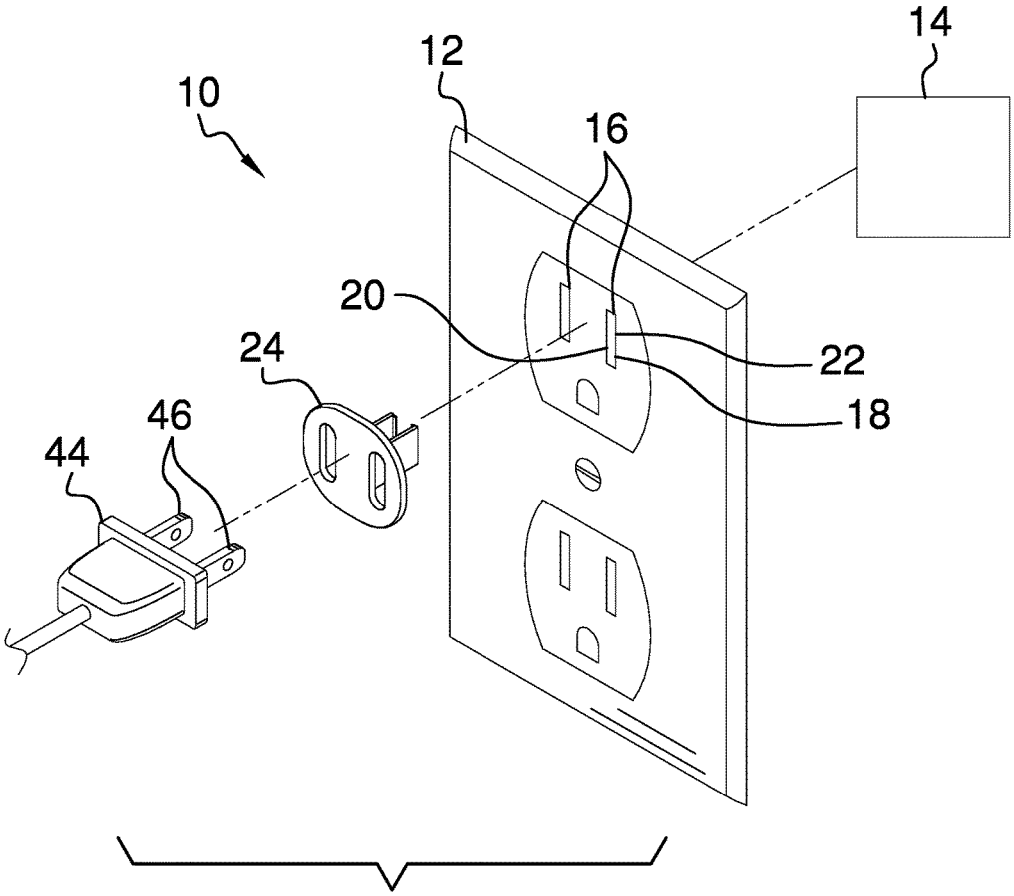
FIG. 5 is a perspective in-use view of an embodiment of the disclosure.

With reference now to the drawings, and in particular to FIGS. 1 through 5 thereof, a new outlet device embodying the principles and concepts of an embodiment of the disclosure and generally designated by the reference numeral 10 will be described.

As best illustrated in FIGS. 1 through 5, the electrical outlet system 10 generally comprises a female electrical outlet 12 that is electrically coupled to a power source 14. The female electrical outlet 12 has a pair of contacts 16. Each of the contacts 16 extends inwardly on the female electrical outlet 12 and each of the contacts 16 has a bounding edge 18. The bounding edge 18 has an inwardly facing side 20 and an outwardly facing side 22. The electrical outlet 12 may comprise a GFI outlet or the like.

An adapter 24 is removably coupled to the female electrical outlet 12 and the adapter 24 is positioned in each of the contacts 16. The adapter 24 is comprised of an electrically insulating material. The adapter 24 comprises a plate 26 that has a first surface 28 and a second surface 30. The plate 26 has a pair of slots 32 and each of the slots 32 extends through the first surface 28 and the second surface 30. The slots 32 are spaced apart from each other.

A pair of tabs 34 is provided and each of the tabs 34 is coupled to and extends away from the second surface 30. The tabs 34 are spaced apart from each other and each of the tabs 34 has an inwardly facing surface 36. Each of the tabs 34 is oriented having the inwardly facing surface 36 facing a center 38 of the plate 26.

Each of the tabs 34 has a distal end 40 with respect to the plate 26. Each of the tabs 34 has a lip 42 extending away from the inwardly facing surface 36. The lip 42 is positioned on the distal end 40 of the associated tab 34. Each of the tabs 34 is aligned with an associated one of the slots 32.

Each of the tabs 34 is inserted into an associated one of the contacts 16. Each of the tabs 34 abuts the inwardly facing side 20 of the associated contact 16. Thus, each of the tabs 34 reduces an open distance between the inwardly facing side 20 and the outwardly facing side 22 of the associated contact 16. The lip 42 corresponding to each of the tabs 34 frictionally engages the inwardly facing side 20 of the associated contact 16. Thus, the adapter 24 is removably retained in the female electrical outlet 12.

A plug 44 is provided and the plug 44 has a pair of terminals 46. The terminals 46 are spaced apart from each other. Each of the terminals 46 is inserted through an associated one of the slots 32. Each of the terminals 46 is electrically coupled to an associated one of the contacts 16. The plug 44 may be electrically coupled to an extrinsic electrical device such as a power tool or the like.

The adapter 24 inhibits the terminals 46 from falling out of the contacts 16. Each of the terminals 46 is positioned between an associated one of the tabs 34 and the outwardly facing side 22 of the associated contact 16. Thus, each of the terminals 46 is frictionally retained between the associated tabs 34 and the associated contact 16. The adapter 24 is positioned in the female electrical outlet 12 when the contacts 16 no longer frictionally retain the plug 44 in the female electrical outlet 12.

In use, the adapter 24 is plugged into the contacts 16. The adapter 24 is plugged into the contacts 16 when the plug 44 will not remain plugged into the female electrical outlet 12. The plug 44 is plugged into the contacts 16 when the adapter 24 is plugged into the contacts 16. The adapter 24 frictionally engages the plug 44 thereby inhibiting the plug 44 from falling out of the female electrical outlet 12.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An electrical outlet system comprising:

a female electrical outlet being electrically coupled to a power source, said female electrical outlet having a pair of contacts, each of said contacts extending inwardly on said female electrical outlet;

an adapter being removably coupled to said female electrical outlet, said adapter having a pair of tabs, said tabs being positioned in each of said contacts, said adapter including a plate having a first surface and a second surface, said plate having a pair of slots, each of said slots extending through said first surface and said second surface, said slots being spaced apart from each other, each of said tabs being coupled to and extending away from said second surface, said tabs being spaced apart from each other, each of said tabs having an inwardly facing surface, each of said tabs being oriented having said inwardly facing surface facing a center of said plate, each of said tabs having a lip extending away from said inwardly facing surface, each of said tabs being aligned with an associated one of said slots; and a plug having a pair of terminals, said terminals being spaced apart from each other, each of said terminals being inserted through said adapter such that each of said terminals is electrically coupled to an associated one of said contacts, said adapter inhibiting said terminals from falling out of said contacts.

2. The system according to claim 1, wherein each of said contacts has a bounding edge, said bounding edge having an inwardly facing side and an outwardly facing side.

3. The system according to claim 1, wherein:

each of said contacts has an inwardly facing side and an outwardly facing side; and each of said tabs is inserted into an associated one of said contacts, each of said tabs abutting said inwardly facing side of said associated contact thereby reducing an open distance between said inwardly facing side and said outwardly facing side of said associated contact, said lip corresponding to each of said tabs frictionally engaging said inwardly facing side of said associated contact such that said adapter is removably retained on said female electrical outlet.

4. The system according to claim 3, wherein each of said terminals is positioned between an associated one of said tabs and said outwardly facing side of said associated contact, each of said terminals being frictionally retained between said associated tabs and said associated contact.

5. An electrical outlet system comprising:

a female electrical outlet being electrically coupled to a power source, said female electrical outlet having a pair of contacts, each of said contacts extending inwardly on said female electrical outlet, each of said contacts having a bounding edge, said bounding edge having an inwardly facing side and an outwardly facing side;

an adapter being removably coupled to said female electrical outlet, said adapter comprising:

a plate having a first surface and a second surface, said plate having a pair of slots, each of said slots extending through said first surface and said second surface, said slots being spaced apart from each other, a pair of tabs, each of said tabs being coupled to and extending away from said second surface, said tabs being spaced apart from each other, each of said tabs having an inwardly facing surface, each of said tabs being oriented having said inwardly facing surface facing a center of said plate, each of said tabs having a lip extending away from said inwardly facing surface, each of said tabs being aligned with an associated one of said slots, each of said tabs being inserted into an associated one of said contacts, each of said tabs abutting said inwardly facing side of said associated contact thereby reducing an open distance between said inwardly facing side and said outwardly facing side of said associated contact, said lip corresponding to each of said tabs frictionally engaging said inwardly facing side of said associated contact such that said adapter is removably retained on said female electrical outlet; and a plug having a pair of terminals, said terminals being spaced apart from each other, each of said terminals being inserted through an associated one of said slots such that each of said terminals is electrically coupled to an associated one of said contacts, said adapter inhibiting said terminals from falling out of said contacts, each of said terminals being positioned between an associated one of said tabs and said outwardly facing side of said associated contact, each of said terminals being frictionally retained between said associated tabs and said associated contact.

* * * * *